US010678179B2

(12) United States Patent
Maeda

(10) Patent No.: US 10,678,179 B2
(45) Date of Patent: Jun. 9, 2020

(54) IMAGE FORMING APPARATUS

(71) Applicant: KYOCERA Document Solutions Inc., Osaka-shi (JP)

(72) Inventor: Hiroyuki Maeda, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/188,622

(22) Filed: Nov. 13, 2018

(65) Prior Publication Data

US 2019/0146398 A1 May 16, 2019

(30) Foreign Application Priority Data

Nov. 15, 2017 (JP) ..... 2017-220106

(51) Int. Cl.

| | |
|---|---|
| ***B65H 1/04*** | (2006.01) |
| ***G03G 15/00*** | (2006.01) |
| ***B65H 1/12*** | (2006.01) |
| ***B65H 3/06*** | (2006.01) |

(52) U.S. Cl.

CPC ..... *G03G 15/6514* (2013.01); *B65H 1/04* (2013.01); *B65H 1/12* (2013.01); *B65H 3/0669* (2013.01); *B65H 2405/324* (2013.01); *B65H 2407/21* (2013.01); *B65H 2511/12* (2013.01); *B65H 2511/22* (2013.01); *B65H 2801/06* (2013.01)

(58) Field of Classification Search

CPC ..... B65H 1/027; B65H 1/04; B65H 2405/31; B65H 2405/32; B65H 2405/35; B65H 3/0669; B65H 1/12; B65H 2511/22; B65H 2511/12

See application file for complete search history.

(56) References Cited

U.S. PATENT DOCUMENTS

2009/0267283 A1* 10/2009 Mizuguchi ..... B65H 1/04 271/3.14

FOREIGN PATENT DOCUMENTS

| | | |
|---|---|---|
| JP | 10-291696 | 11/1998 |
| JP | 10-291698 | 11/2017 |

* cited by examiner

*Primary Examiner* — Thomas A Morrison
(74) *Attorney, Agent, or Firm* — Gerald E. Hespos; Michael J. Porco; Matthew T. Hespos

(57) ABSTRACT

A manual feed tray includes a tray body and a lift unit, and the lift unit includes a lift plate, a lift spring and a pair of cursors. The cursor includes a guide portion. When the manual feed tray is closed from a sheet feeding state of the lift plate, the guide portion comes into contact with a facing wall portion, whereby a downstream side of the lift plate in a covering direction moves downward. Thus, even if the manual feed tray is closed with the lift plate moved upward, the lift plate smoothly moves downward.

7 Claims, 15 Drawing Sheets

IMAGE FORMING APPARATUS

INCORPORATION BY REFERENCE

This application is based on Japanese Patent Application No. 2017-220106 filed with the Japan Patent Office on Nov. 15, 2017, the contents of which are hereby incorporated by reference.

BACKGROUND

The present disclosure relates to an image forming apparatus for forming an image on a sheet.

Conventionally, a sheet feeder is known which is provided in an image forming apparatus for forming an image on a sheet and includes a manual feed tray. The manual feed tray of the sheet feeder is openable and closable with respect to an apparatus body of the image forming apparatus. When the manual feed tray is opened with respect to the apparatus body, a sheet is placed on the manual feed tray. This sheet is carried into the apparatus body and has an image formed thereon.

Conventionally, a technique for making a manual feed tray openable and closable with respect to a side wall of an apparatus body of an image forming apparatus is known. Further, the manual feed tray includes a pair of side guides (cursors) for restricting the position of a sheet in a width direction. To prevent the interference of the side guides with the apparatus body when the manual feed tray is closed on the apparatus body, recesses are formed in the apparatus body. The above interference is prevented by housing the side guides into the recesses.

A manual feed tray is provided with a lift plate to bring a sheet on the manual feed tray into contact with a sheet feed roller provided in an apparatus body of an image forming apparatus. When this lift plate swings about a pivot portion arranged on an upstream side in a sheet feeding direction, a tip part of the lift plate on a downstream side in the sheet feeding direction vertically moves.

SUMMARY

An image forming apparatus according to one aspect of the present disclosure includes an apparatus body, an image forming unit, a manual feed tray, a sheet feed roller and a pair of facing wall portions. The image forming unit is arranged in the apparatus body and forms an image on a sheet. The manual feed tray is supported openably and closably with respect to a side surface of the apparatus body and includes a sheet placing portion on which the sheet is to be placed in an open state with respect to the apparatus body. The sheet feed roller is provided in the side surface and conveys the sheet placed on the manual feed tray in a predetermined conveying direction. The pair of the facing wall portions is arranged both sides of the sheet feed roller in a sheet width direction orthogonal to the conveying direction in the side surface and arranged to face the manual feed tray in a closed state of the manual feed tray with respect to the side surface. The manual feed tray includes a tray body, a lift plate, a biasing member and a pair of cursors. The tray body constitutes the sheet placing portion. The lift plate is arranged on a downstream side of the tray body in the conveying direction and supported swingably on the tray body to bring a downstream part of the sheet in the conveying direction into contact with the sheet feed roller. The biasing member is arranged between the lift plate and the tray body and biases the lift plate so as to bring the sheet placed on the sheet placing portion into contact with the sheet feed roller. The pair of cursors is supported on the lift plate and restrict a position of the sheet in the sheet width direction. The lift plate includes a pair of pivot portions arranged on an upstream side in the conveying direction and supported on the tray body and the lift plate is swingable in directions toward and away from an upper surface of the tray body about the pair of pivot portions. At least one of the pair of cursors includes a pressed portion which is formed on a downstream end part of the cursor and arranged with a predetermined interval between the facing wall portion and the pressed portion in a sheet feeding state where the downstream part of the lift plate is moved upward with the manual feed tray in the open state. The downstream part of the lift plate moves in the direction toward the upper surface of the tray body against a biasing force of the biasing member by the contact of the pressed portion with the facing wall portion when the manual feed tray is closed in the sheet feeding state.

DETAILED DESCRIPTION

Figure 1:
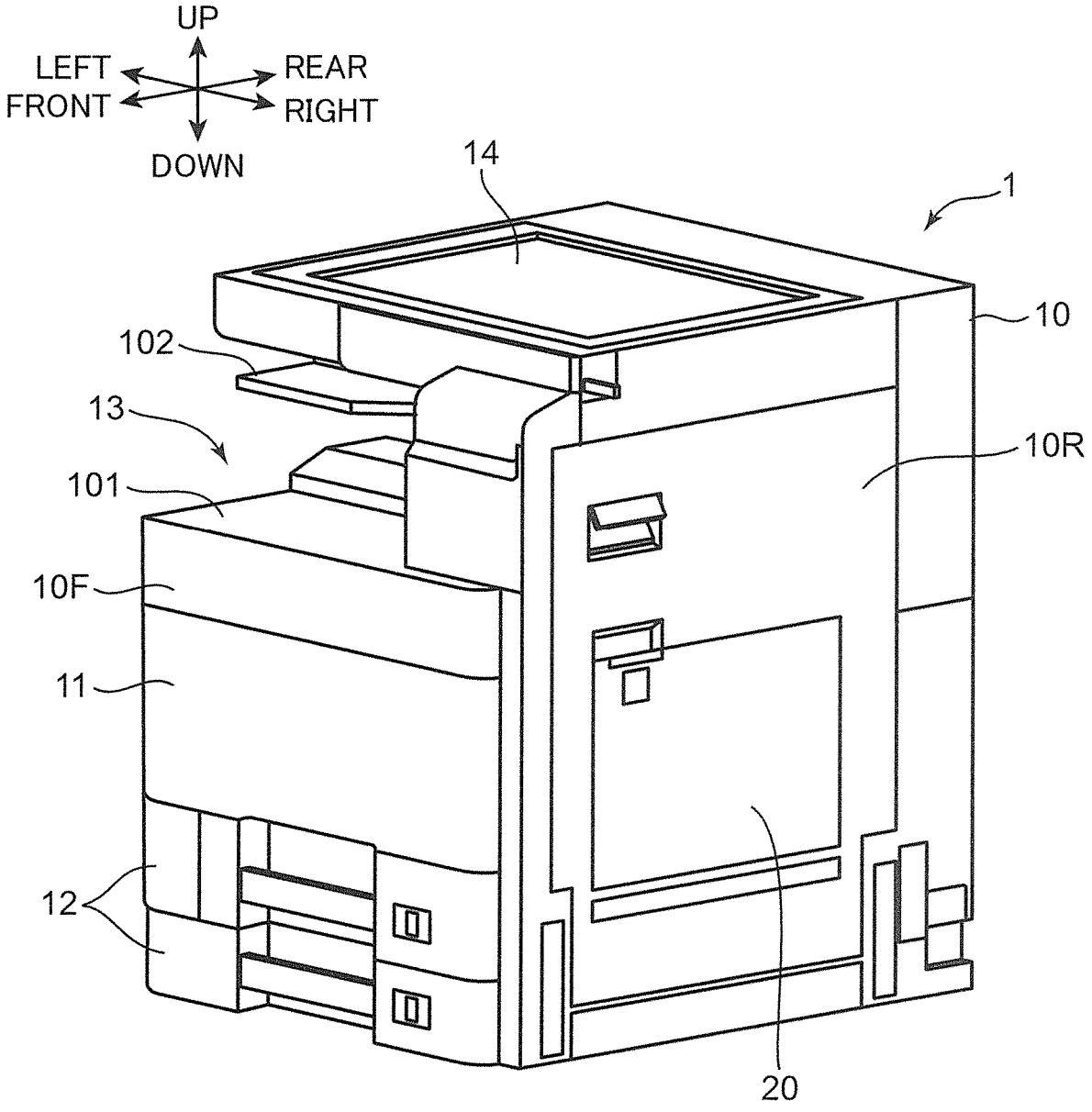
FIG. 1 is a perspective view showing an image forming apparatus according to a first embodiment of the present disclosure.

Hereinafter, embodiments of the present disclosure are described with reference to the drawings. FIG. 1 is a perspective view showing the external appearance of an image forming apparatus 1 according to a first embodiment of the present disclosure. Although an internal discharge type copier is illustrated as the image forming apparatus 1 here, the image forming apparatus may be a printer, a facsimile machine or a complex machine provided with these functions.

The image forming apparatus 1 includes an apparatus body 10 having a substantially rectangular parallelepiped housing structure and provided with an internal space. The apparatus body 10 performs an image forming process on a sheet. An unillustrated automatic document feeder is arranged above the apparatus body 10. The apparatus body 10 includes a front wall 10F and a right wall 10R. The front wall 10F defines a front surface part of the apparatus body 10, and the right wall 10F defines a right surface part of the apparatus body 10.

Further, the image forming apparatus 1 includes an image forming unit 11, a sheet cassette 12, a discharge space 13, a contact glass 14 and a manual feed tray 20.

The image forming unit 11 forms images on sheets stored in the sheet cassette 12 or a sheet placed on the manual feed tray 20. In this embodiment, a toner image is formed on a sheet based on a known electrophotographic method. Note that an image forming method of the image forming unit 11 may be another method such as an ink jet method.

The sheet cassette 12 is arranged below the image forming unit 11 and can be pulled out forward from the apparatus body 10. Sheets are stored in the sheet cassette 12.

The discharge space 13 is a space formed by recessing a left surface part of the apparatus body 10. A sheet having an image formed thereon in the image forming unit 11 is discharged to the discharge space 13. In this embodiment, there are two sheet discharge destinations, i.e. a sheet discharge portion 101 and a sheet discharge tray 102.

The manual feed tray 20 is rotatably supported on the right wall 10R of the apparatus body 10 and openable and closable with respect to the apparatus body 10. The manual feed tray 20 includes a sheet placing portion on which a sheet is to be placed in an open state with respect to the apparatus body 10.

Figure 2:
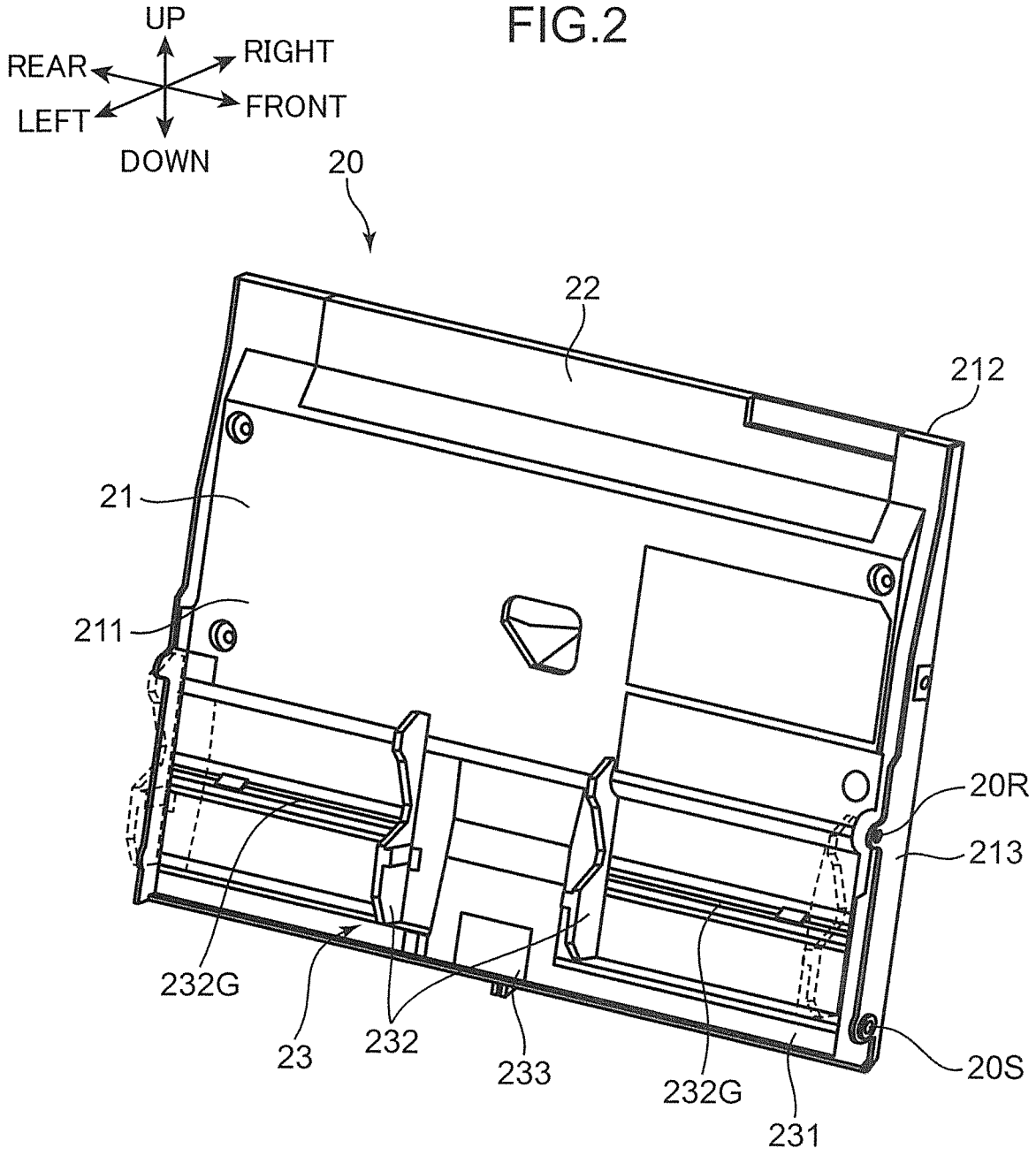
FIG. 2 is a perspective view of a manual feed tray of the image forming apparatus according to the first embodiment of the present disclosure.
Figure 3:
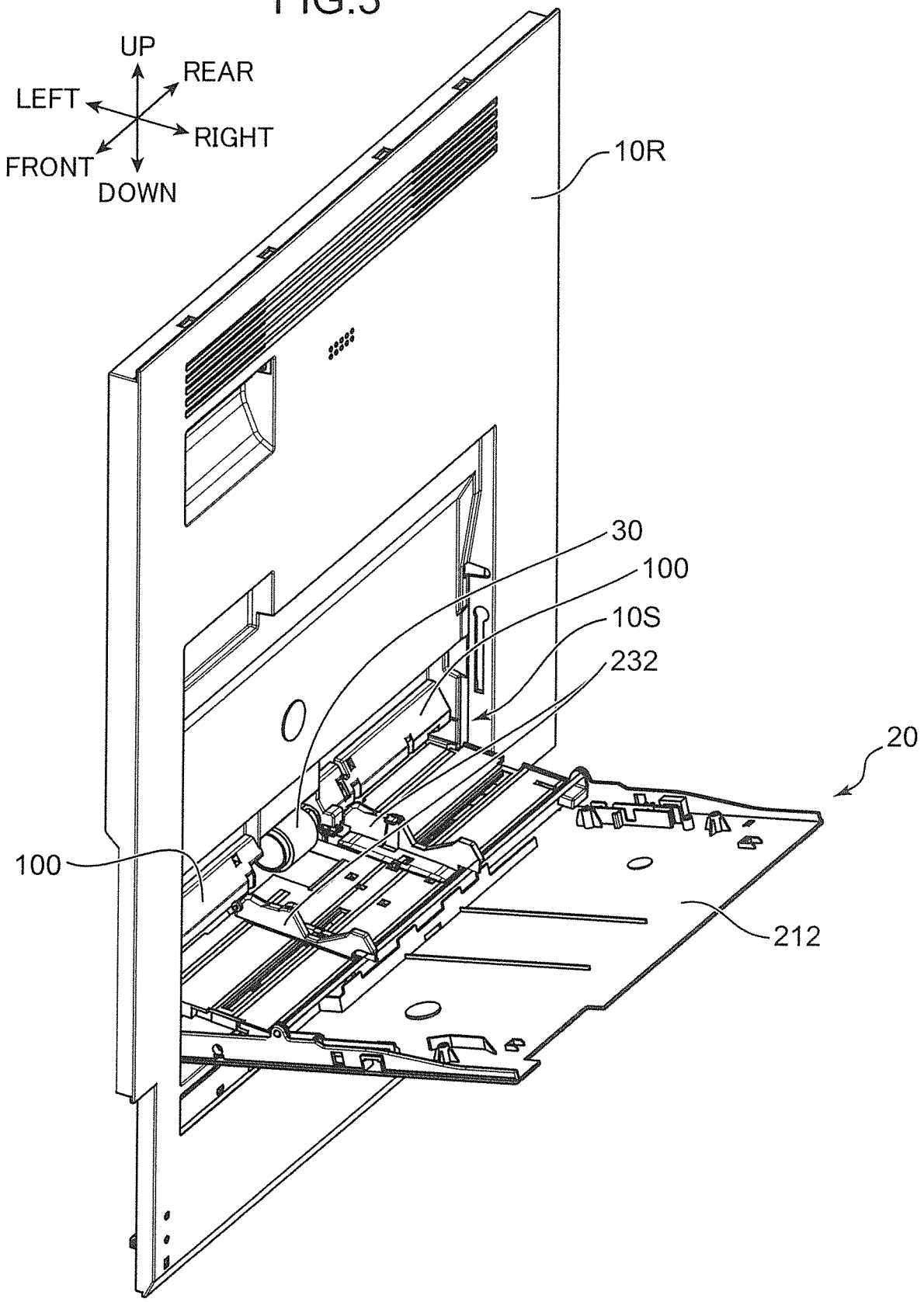
FIG. 3 is a perspective view showing a state where the manual feed tray is open with respect to an apparatus body of the image forming apparatus according to the first embodiment of the present disclosure.
Figure 4:
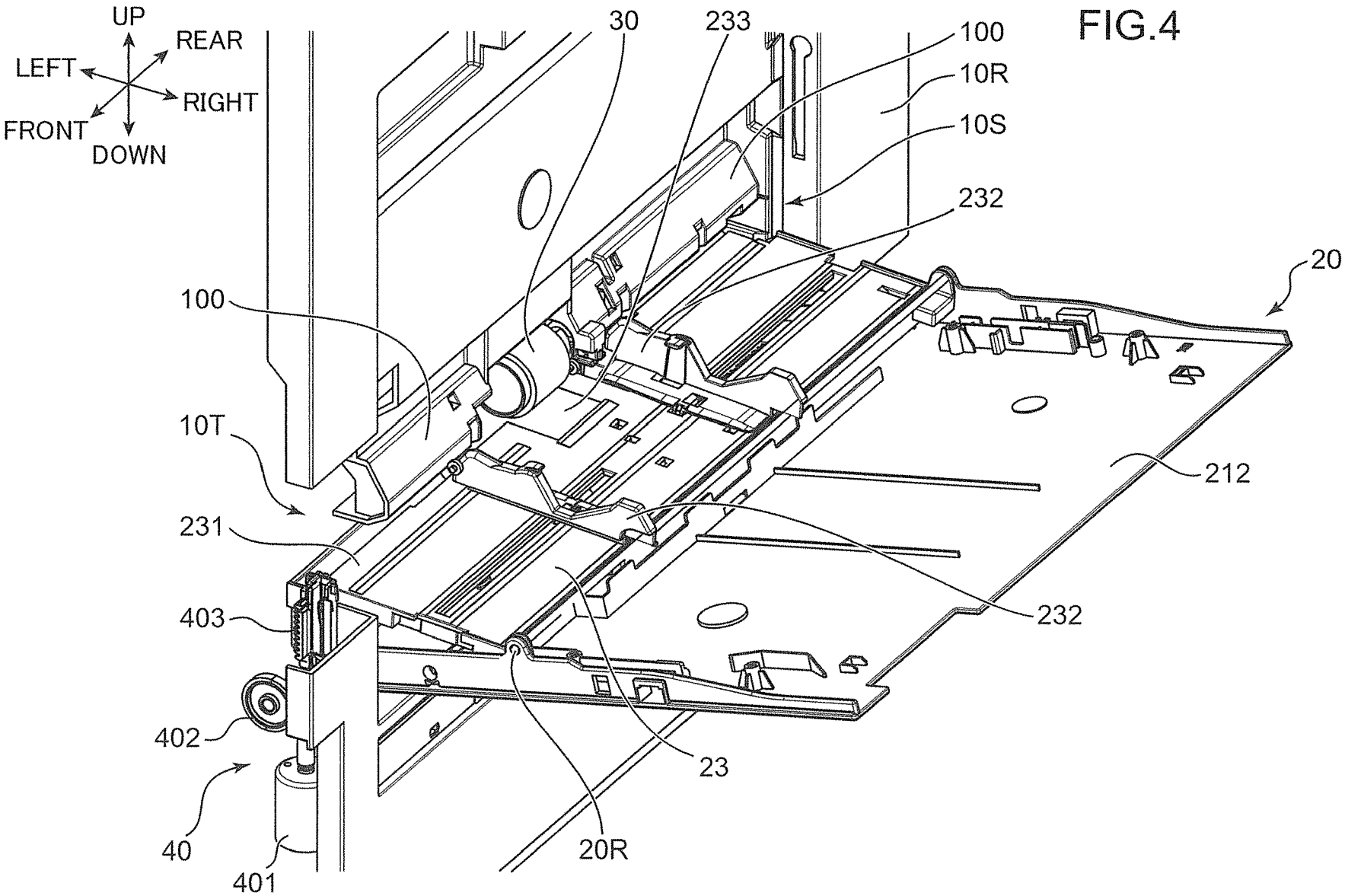
FIG. 4 is a perspective view showing a state where the manual feed tray is open with respect to the apparatus body of the image forming apparatus according to the first embodiment of the present disclosure and a lift plate is a sheet feeding state.
Figure 5:
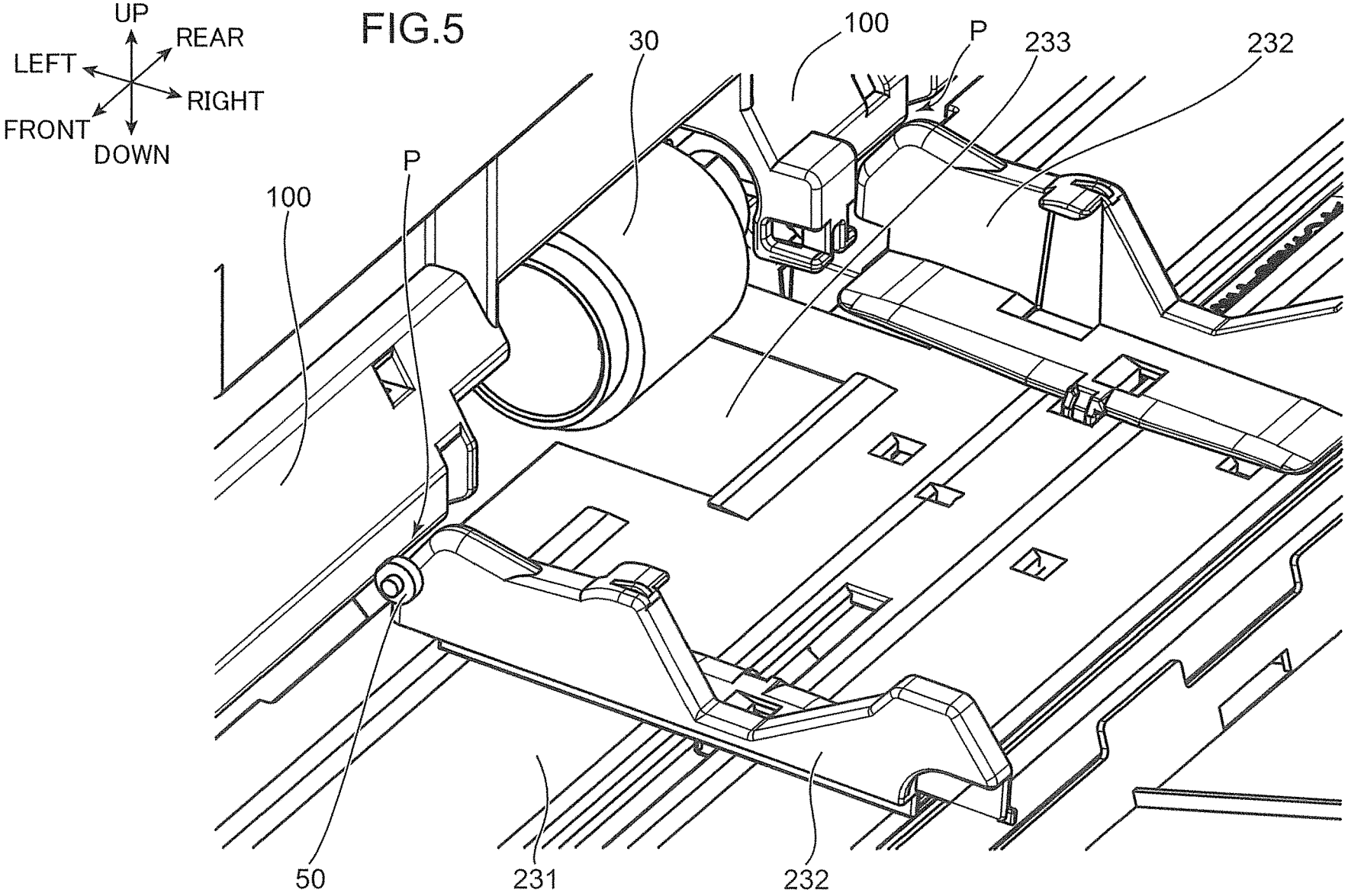
FIG. 5 is a perspective view enlargedly showing a part of the manual feed tray of FIG. 4.

FIG. 2 is a perspective view of the manual feed tray 20 according to this embodiment. FIG. 3 is a perspective view showing a state where the manual feed tray 20 is open with respect to the apparatus body 10 of the image forming apparatus 1 according to this embodiment. FIG. 4 is a perspective view enlargedly showing the periphery of the manual feed tray 20 when a lift plate 231 is in a sheet feeding state. Note that a part of the apparatus body 10 (cut portion 10T) is cut in FIG. 4 as compared to FIG. 3 for description. FIG. 5 is a perspective view further enlargedly showing a part of the manual feed tray 20 of FIG. 4.

With reference to FIGS. 3 and 4, the apparatus body 10 includes a sheet feed roller 30 and a pair of facing wall portions 100. The sheet feed roller 30 is rotatably supported in the right wall 10R, receives a rotational drive force from an unillustrated motor and conveys a sheet placed on the manual feed tray 20 in a predetermined conveying direction (leftward direction of FIGS. 3 and 4).

The pair of facing wall portions 100 are arranged both sides of the sheet feed roller 30 in a sheet width direction (front-rear direction of FIGS. 3 and 4) orthogonal to the conveying direction. The pair of facing wall portions 100 are arranged to face the manual feed tray 20 in a closed state of the manual feed tray 20 with respect to the apparatus body 10. The pair of facing wall portions 100 constitutes an upper guide plate, out of a sheet feed opening for feeding the sheet. Note that, in this embodiment, the sheet feed roller 30 is arranged in a central part of the apparatus body 10 (right wall 10R) in the sheet width direction, and the pair of facing wall portions 100 are arranged on both sides across the sheet feed roller 30 in the sheet width direction. Further, as shown in FIGS. 3 and 4, a tray housing portion 10S capable of housing the manual feed tray 20 is formed by recessing a part of the right wall 10R.

As shown in FIG. 2, the manual feed tray 20 is a member having a rectangular shape. When the manual feed tray 20 is opened, a sheet is placed on an upper surface part (sheet placing portion) thereof. Thus, the manual feed tray 20 is so oriented that the upper surface part thereof faces substantially upward in the open state. The manual feed tray 20 includes a tray body 21, an auxiliary tray 22 which can be pulled from the tray body 21, and a lift unit 23. When the auxiliary tray 22 is pulled out from the tray body 21, a length of the manual feed tray 20 in the sheet conveying direction increases. As a result, a sheet of a larger size can be placed on the manual feed tray 20.

The tray body 21 includes a tray upper wall portion 211, a tray bottom wall portion 212 (FIG. 3), a pair of front and rear tray side wall portions 213, a pair of front and rear link pivot portions 20R and a pair of front and rear rotation pivot portions 20S.

The tray upper wall portion 211 defines an upper surface part of the tray body 21 in the state where the manual feed tray 20 is open, and constitutes the above sheet plating portion. Note that the tray upper wall portion 211 is equivalent to an inner side surface of the manual feed tray 20 in the state where the manual feed tray 20 is closed on the apparatus body 10 (FIG. 1). Note that the tray upper wall portion 211 is not shown in FIGS. 3 and 4.

Similarly, the tray bottom wall portion 212 defines a lower surface part of the tray body 21 in the state where the manual feed tray 20 is open. In other words, the tray bottom wall portion 212 is arranged on a side opposite to the tray upper wall portion 211 in the tray body 21. Note that the tray bottom wall portion 212 is equivalent to an outer side surface of the manual feed tray 20 and defines a part of the right wall 10R of the apparatus body 10 in the state where the manual feed tray 20 is closed on the apparatus body 10 (FIG. 1). A space part in which the auxiliary tray 22 is to be housed is formed with a predetermined clearance between the tray upper wall portion 211 and the tray bottom wall portion 212.

The pair of tray side wall portions 213 is side walls arranged on both end parts of the tray body 21 in the front-rear direction and respectively connecting the tray upper wall portion 211 and the tray bottom wall portion 212. Note that, out of the pair of tray side wall portions 213, only the tray side wall portion 213 on the front side is shown in FIG. 2.

The link pivot portion 20R is arranged substantially in a central part of the tray side wall portion 213 in the sheet conveying direction. The link pivot portion 20R is a hole open in the tray side wall portion 213. One end of an unillustrated link member is rotatably supported in the link pivot portion 20R. On the other hand, the other end of the link member is rotatably supported on the right wall 10R of the apparatus body 10. The link member restricts an opening angle of the manual feed tray 20. Further, the link pivot portion 20R functions as a supporting point in a swinging movement of the lift plate 231 to be described later.

The rotation pivot portion 20S is arranged on a lower end part (downstream end part in the sheet conveying direction) of the tray side wall portion 213. The rotation pivot portion 20S is rotatably supported on the right wall 10R of the apparatus body 10 and serves as a supporting point in opening and closing movements of the manual feed tray 20 with respect to the apparatus body 10. Note that the tray side wall portion 213, the link pivot portion 20R and the rotation pivot portion 20S on the front side are shown in FIG. 2, but similar members are respectively arranged also on the rear side.

The lift unit 23 (FIG. 2) is arranged on a downstream side of the tray body 21 in the conveying direction, and swingably supported on the tray body 21 to bring a downstream side of the sheet in the conveying direction into contact with the sheet feed roller 30.

Figure 10:
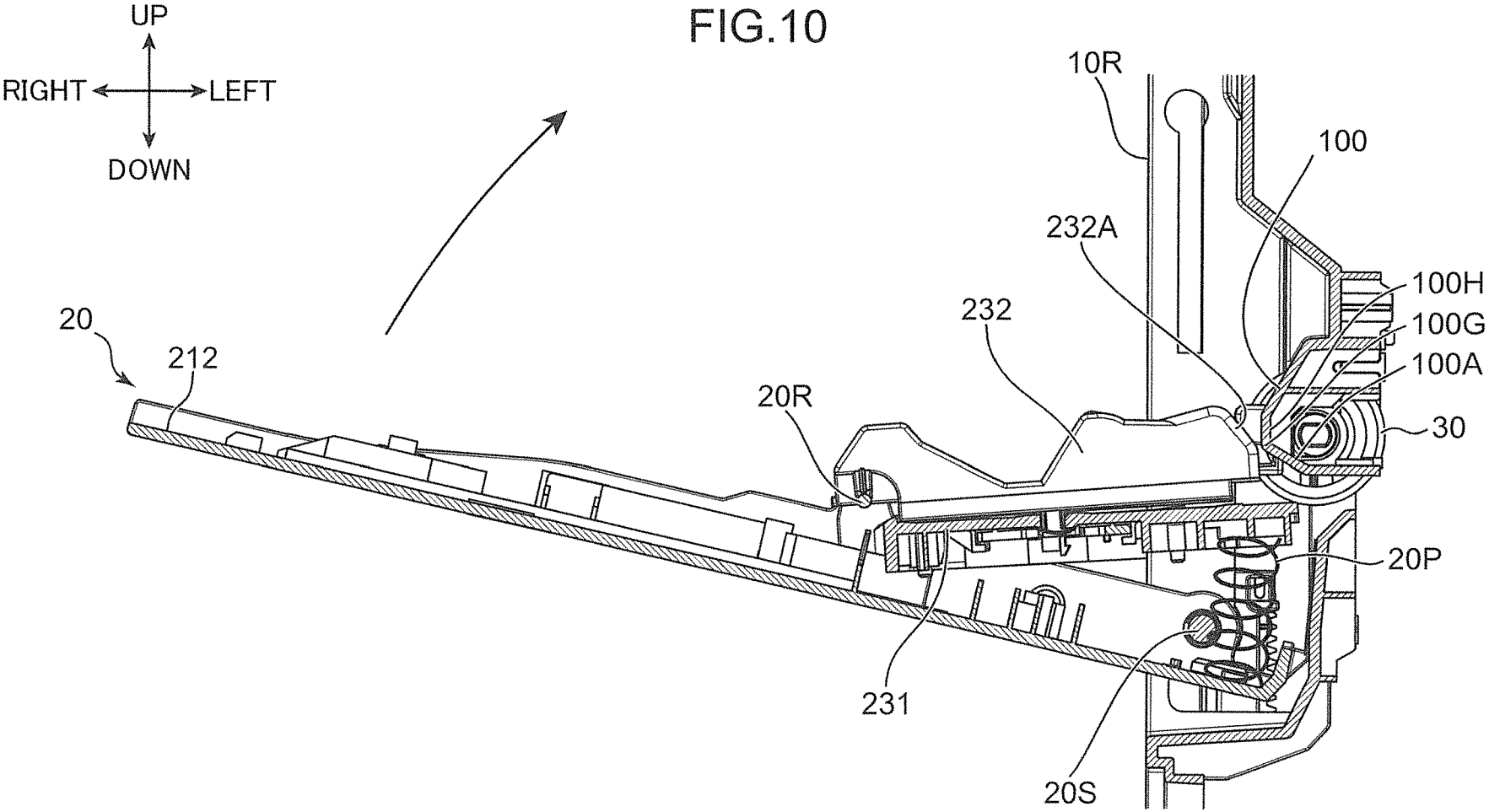
FIG. 10 is a section showing a state where a manual feed tray in a sheet feeding state is closed with respect to an apparatus body of an image forming apparatus according to a second embodiment of the present disclosure.

The lift unit 23 includes one lift plate 231, a pair of front and rear cursors 232 attached to the lift plate 231, a pair of front and rear guide grooves 232G, a sheet feed pad 233 and a lift spring 20P (see FIG. 10). Further, a rack and a pinion (not shown) for sliding the pair of cursors 232 are provided on the back surface of the lift plate 231.

The lift plate 231 constitutes the above sheet placing portion. The lift plate 231 includes a shaft-like pivot portion arranged on an upstream side in the conveying direction and rotatably supported on the link pivot portions 20R of the tray body 21. The lift plate 231 is swingable upward and downward (directions toward and away from the tray body 21) about this pivot portion.

The lift spring 20P is arranged between the lift plate 231 and the tray body 21 to bias the lift plate 231 upward (in a direction to bring the sheet into contact with the sheet feed roller 30).

The pair of cursors 232 are respectively plate-like members arranged to extend in the sheet conveying direction. Note that a state where the pair of cursors 232 are respectively moved outward in the sheet width direction (front-rear direction) is shown by broken line in FIG. 2. The pair of cursors 232 are supported on the lift plate 231 movably along the sheet width direction. Specifically, the pair of guide grooves 232G are groove portions formed along the sheet width direction perpendicular to the sheet conveying direction on the lift plate 231. The pair of cursors 232 are connected to each other by the above rack and pinion and synchronously movable in directions opposite to each other along the sheet width direction along the guide grooves 232G. The position of the sheet placed on the tray body 21 in the sheet width direction (front-rear direction) is restricted by sliding movements of the pair of cursors 232.

The sheet feed pad 233 is arranged in a central part of the lift plate 231 in the sheet width direction. A nip portion is formed between the sheet feed pad 233 and the sheet feed roller 30 provided in the apparatus body 10.

Figure 6:
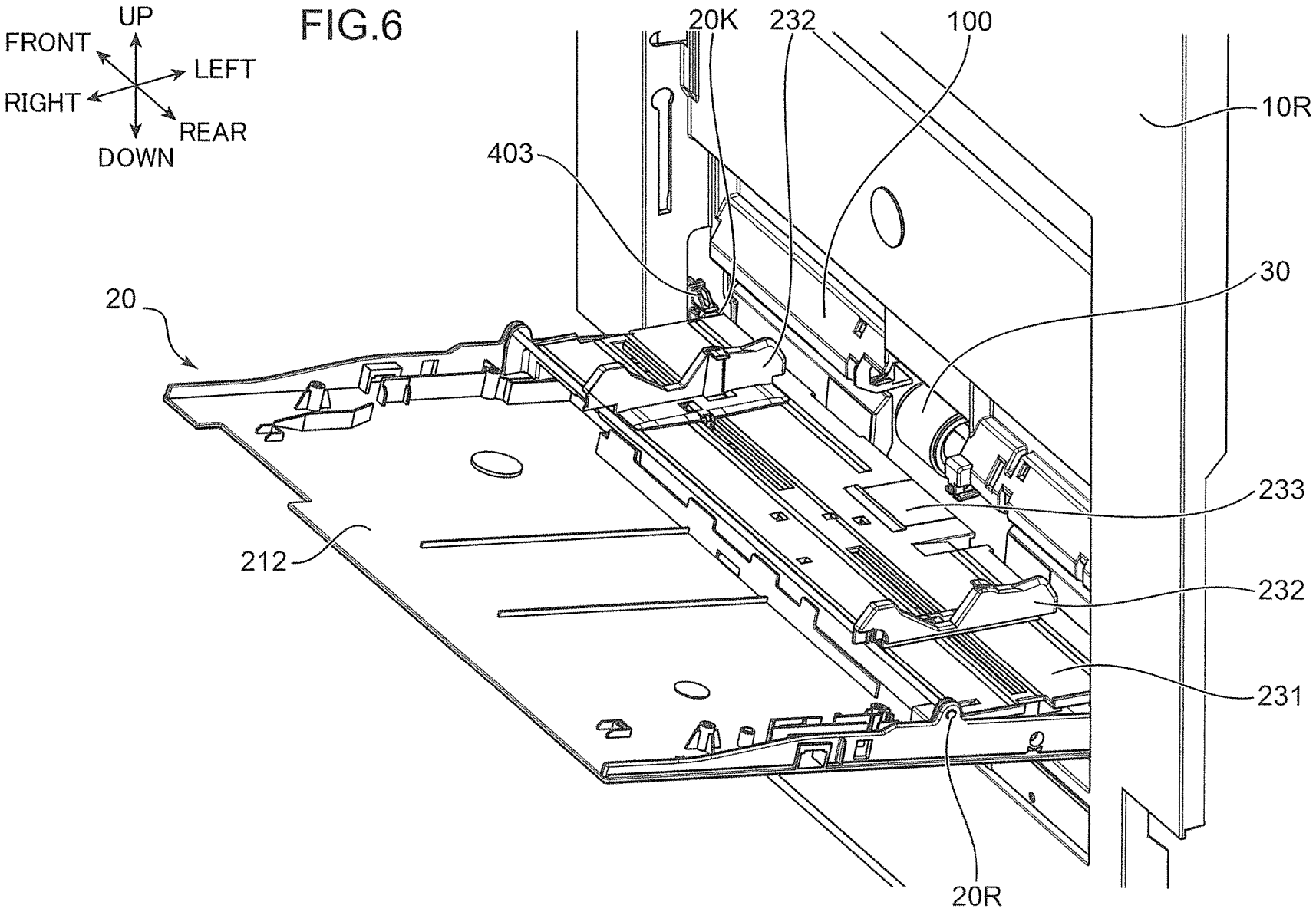
FIG. 6 is a perspective view showing a state where the manual feed tray is open with respect to the apparatus body of the image forming apparatus according to the first embodiment of the present disclosure and the lift plate is in a standby state.
Figure 7:
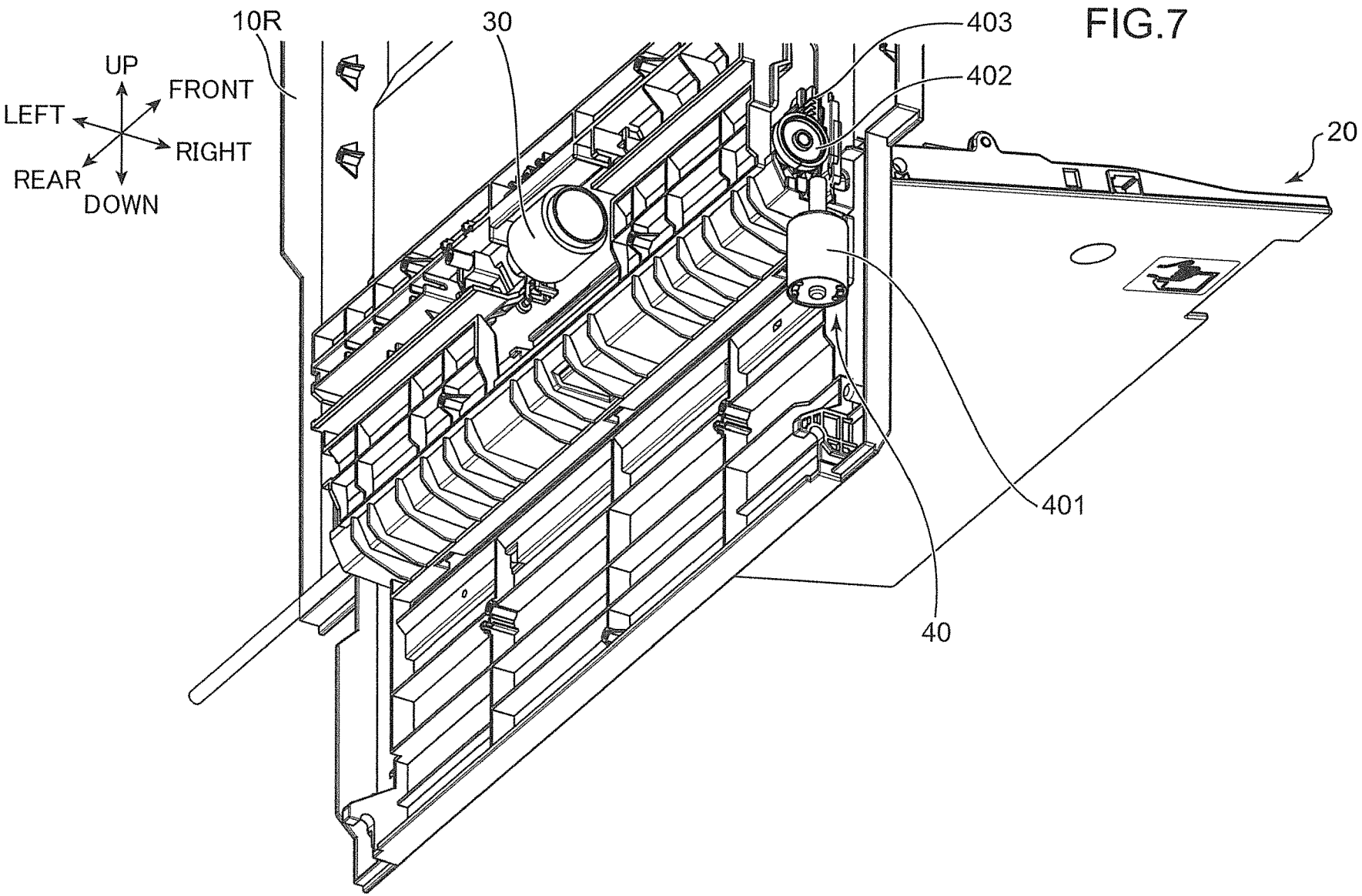
FIG. 7 is a perspective view showing the state where the manual feed tray is open with respect to the apparatus body of the image forming apparatus according to the first embodiment of the present disclosure and the lift plate is in the standby state.
Figure 8:
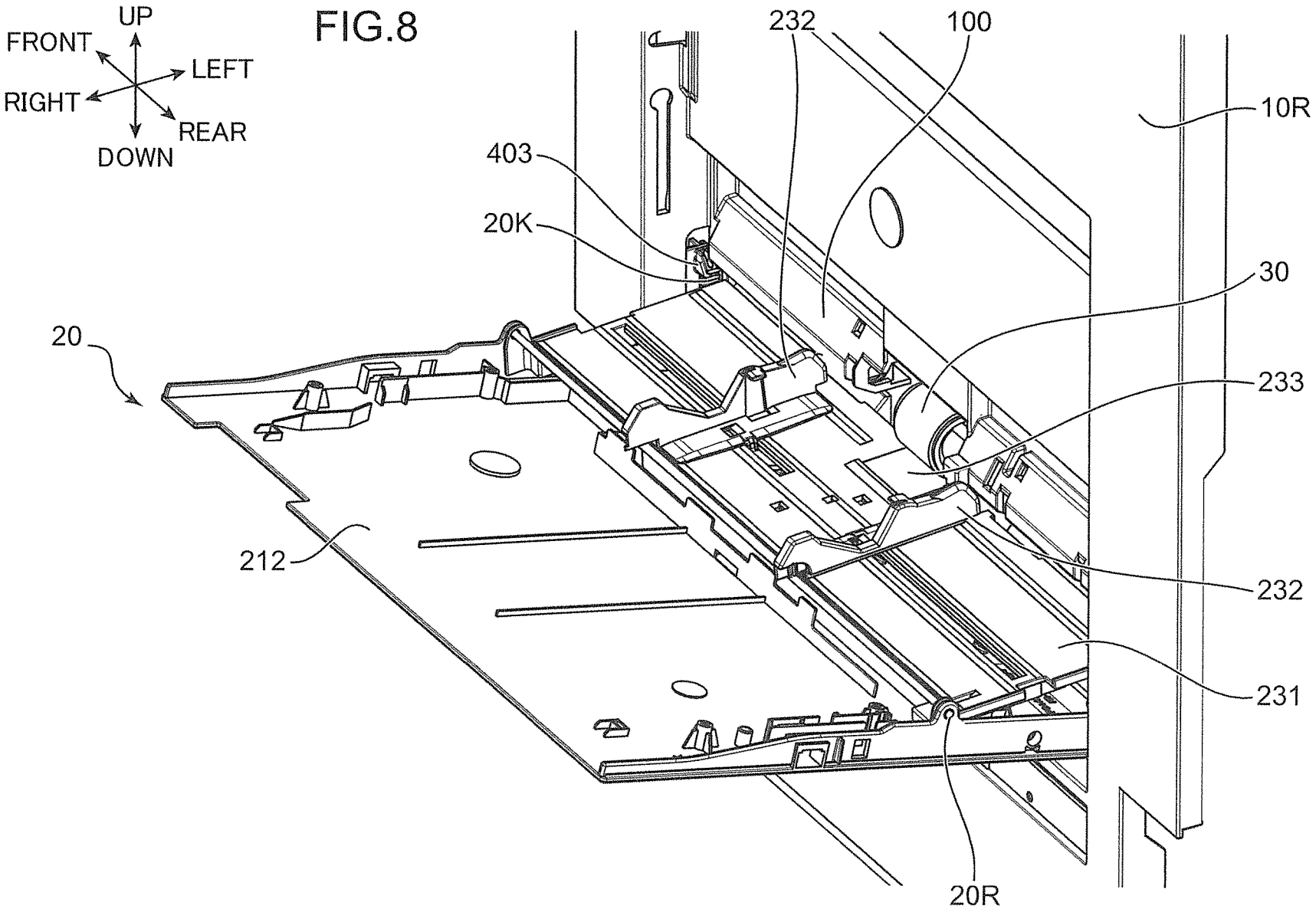
FIG. 8 is a perspective view showing the state where the manual feed tray is open with respect to the apparatus body of the image forming apparatus according to the first embodiment of the present disclosure and the lift plate is in the sheet feeding state.
Figure 9:
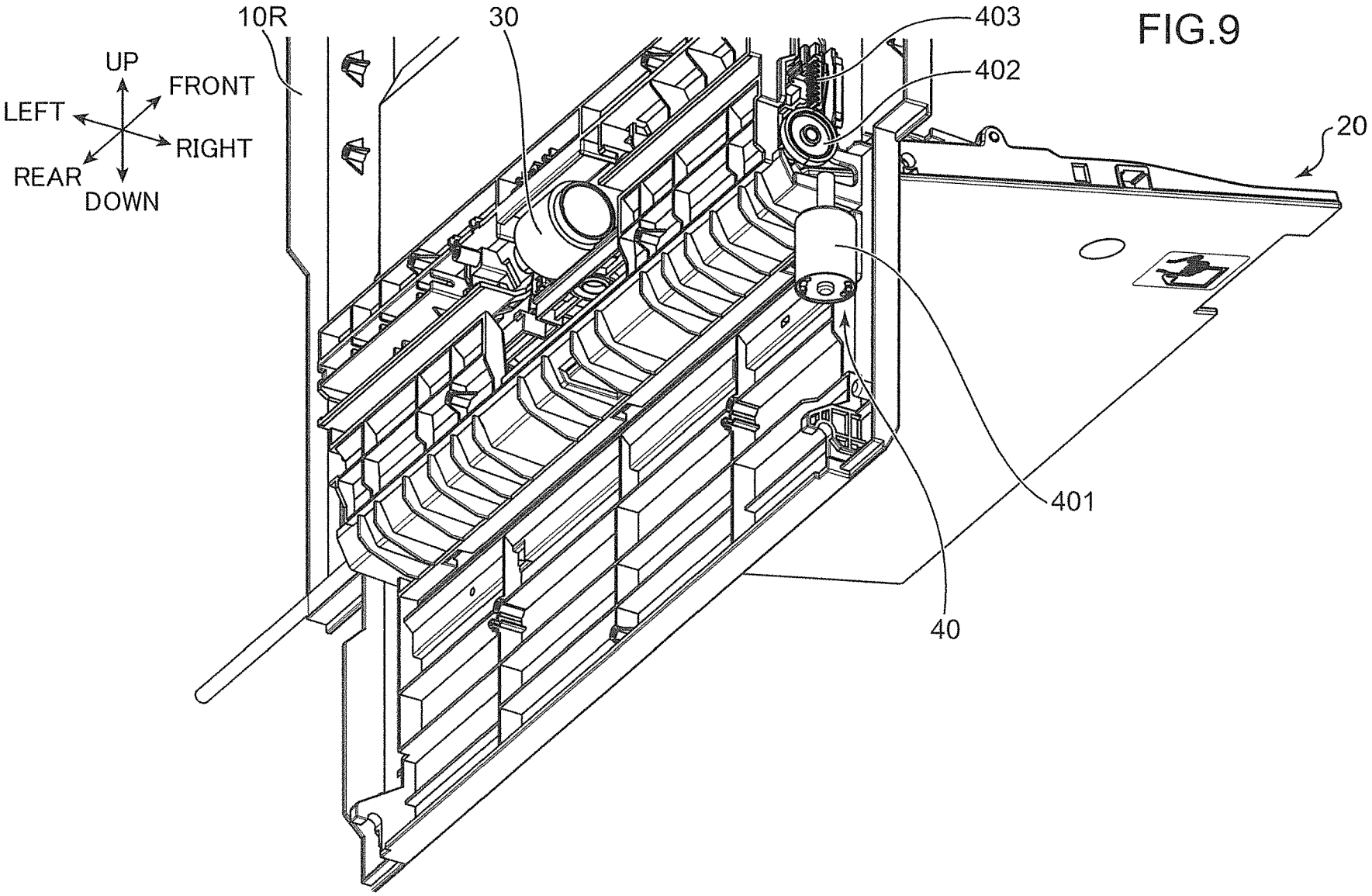
FIG. 9 is a perspective view showing the state where the manual feed tray is open with respect to the apparatus body of the image forming apparatus according to the first embodiment of the present disclosure and the lift plate is in the sheet feeding state.

FIGS. 6 and 7 are perspective views showing a state where the manual feed tray 20 is open with respect to the apparatus body 10 of the image forming apparatus 1 according to this embodiment and the lift plate 231 is moved downward and in a standby state (sheet non-feeding state). FIGS. 8 and 9 are perspective views showing a state where the manual feed tray 20 is open with respect to the apparatus body 10 of the image forming apparatus 1 according to this embodiment and the lift plate 231 is moved upward and in a sheet feeding state.

With reference to FIG. 4, the image forming apparatus 1 further includes a drive unit 40. The drive unit 40 is arranged on a front side of the manual feed tray 20 and on the back surface of the right wall 10R. The drive unit 40 has a function of swinging the lift plate 231 upward and downward. The drive unit 40 includes a motor 401, a pinion gear 402 and a pressing piece 403. The motor 401 is rotated in a predetermined rotation direction to generate a rotational drive force to be transmitted to the lift plate 231. The pinion gear 402 transmits the rotational drive force of the motor 401 to the pressing piece 403. The pressing piece 403 includes a rack gear engaged with the pinion gear 402 and is slid upward and downward by the rotational drive force.

On the other hand, a tray engaging portion 20K is formed on a corner of a left front end part of the aforementioned lift plate 231 (FIG. 6). The tray engaging portion 20K is engageable with the pressing piece 403. According to an upward movement of the pressing piece 403, the lift plate 231 including the tray engaging portion 20K is moved upward (to a sheet feeding position) by receiving a biasing force of the lift spring 20P. On the other hand, when the pressing piece 403 moves downward, the pressing piece 403 pushes down the tray engaging portion 20K, whereby the lift plate 231 including the tray engaging portion 20K moves downward (to a sheet non-feeding position). As a result, the lift plate 231 swings upward and downward with the link pivot portions 20R as a support point. Particularly, the lift plate 231 moves upward to the sheet feeding position by a spring pressure of the lift spring 20P and is pressed into contact with the sheet feed roller 30 at a predetermined sheet feeding pressure. When a sheet feeding operation is finished, the lift plate 231 is moved downward. In this case, the pressing piece 403 acts to push down the tray engaging portion 20K. Specifically, the pressing piece 403 including the rack gear is lowered by the rotation of the pinion gear 402 coupled to the drive motor 401. On the other hand, in a standby state of the image forming apparatus 1, the lift plate 231 is arranged (restrained) at the sheet non-feeding position by the pressing piece 403 arranged at a lower position. If an unillustrated print button of the image forming apparatus 1 is pressed by a user in this state, the motor 401 rotates and the pressing piece 403 moves upward. Following this, the lift plate 231 is moved upward by the force of the lift spring 20P to reach the sheet feeding position. As a result, an upward movement of the lift plate 231 is stopped, but the pressing piece 403 is stopped at a higher position. In this state, the sheet can be fed. When the sheet feeding operation is finished, the motor 401 rotates in a reverse direction and the pressing piece 403 moves downward while pressing the tray engaging portion 20K and stops at the sheet non-feeding position. Note that an unillustrated PI sensor for detecting the position of the lift plate 231 may be provided and upward and downward movements of the pressing piece 403 (rotation of the motor 401) may be controlled according to an output of the PI sensor.

With reference to FIG. 5, the cursor 232 includes a pulley 50 (pressed portion, rotating member). The pulley 50 is rotatably supported on a downstream side of a body part of the cursor 232 in the conveying direction. Note that although the front cursor 232, out of the pair of cursors 232, is provided with the pulley 50 in FIG. 5, the pulley 50 may be provided on the rear cursor 232 or the pulley 50 may be provided on each of the pair of cursors 232.

Note that in the sheet feeding state where the downstream side of the lift plate 231 in the conveying direction is moved upward by the drive unit 40, the outer peripheral surface of the pulley 50 is arranged closer to the facing wall portion 100 than a downstream end part of the cursor 232 in the conveying direction. As a result, a clearance between the pulley 50 and the facing wall portion 100 is set to be narrower than a clearance P (FIG. 5) between the cursor 232 and the facing wall portion 100.

As described above, in this embodiment, the manual feed tray 20 is provided with the lift plate 231 to bring a sheet on the manual feed tray 20 into contact with the sheet feed roller 30 provided in the apparatus body 10 of the image forming apparatus 1. The lift plate 231 swings about the link pivot portions 20R arranged on the upstream side of the lift plate 231 in the conveying direction, whereby a tip part on the downstream side of the lift plate 231 in the conveying direction moves upward and downward. Thus, if the manual feed tray is closed by the user in the sheet feeding state where the tip part of the lift plate 231 is moved upward, there is a possibility that the tip part of the lift plate 231 and the facing wall portions 100 (parts of the apparatus body) of the apparatus body strongly interfere to damage the facing wall portions 100 and the lift unit 23.

In this embodiment, the cursor 232 is provided with the pulley 50 to solve such a problem. As shown in FIG. 5, in the sheet feeding state where the downstream side of the lift plate 231 in the conveying direction is moved upward with the manual feed tray 20 in an open state, the pulley 50 is arranged with a predetermined interval (clearance) between the facing wall portion 100 and the pulley 50. When the closing of the manual feed tray 20 is started by the user in this sheet feeding state, the outer peripheral surface of the pulley 50 comes into contact with the facing wall portion 100. As a result, the pulley 50 receives a drag force for moving the downstream side of the lift plate 231 in the conveying direction downward against the biasing force of the lift spring 20P (see FIG. 10). As a result, the downstream sides of the cursors 232 in the conveying direction smoothly move to positions below the facing wall portions 100, wherefore strong interference of the cursors 232 and the facing wall portions 100 is suppressed. As a result, the damage and fracture of the cursors 232 and the facing wall portions 100 are suppressed. Note that movements of the cursors 232 at this time are the same as in a second embodiment to be described later (see FIGS. 10 to 15).

Next, the second embodiment of the present disclosure is described. Note that since this embodiment differs from the previous first embodiment in the configuration of the pressed portion, this embodiment is described centering on this point of difference and the common configuration is not described. FIGS. 10 to 15 are sections showing a state where a manual feed tray 20 in a sheet feeding state is being closed with respect to an apparatus body 10 of an image forming apparatus according to this embodiment. Note that FIG. 15 is a section showing a state where the manual feed tray 20 is completely closed. Note that, in FIGS. 10 to 15, members having the same functions as the members according to the previous first embodiment are denoted by the same reference signs as in FIGS. 2 to 9.

In this embodiment, a guide portion 232A of a cursor 232 functions as the pressed portion. The guide portion 232A includes an inclined surface formed on a downstream end part of the cursor 232 in a conveying direction and facing to the facing wall portion 100.

On the other hand, a facing wall portion 100 includes a vertical wall 100H (first wall portion) and an inclined wall 100A (second wall portion) (FIG. 10). The vertical wall 100H extends along a vertical direction. Further, the inclined wall 100A is connected to a lower end part of the vertical wall 100H and inclined so as to extend from a lower end part of the vertical wall 100H toward a downstream side (left side) in a conveying direction. As shown in FIG. 10, a ridgeline portion 100G projecting toward the upstream side in the sheet feed direction and the ridgeline portion 100G is formed to extend along a front-rear direction (direction perpendicular to the plane of FIG. 10) in a part where the vertical wall 100H and the inclined wall 100A intersect.

Figure 11:
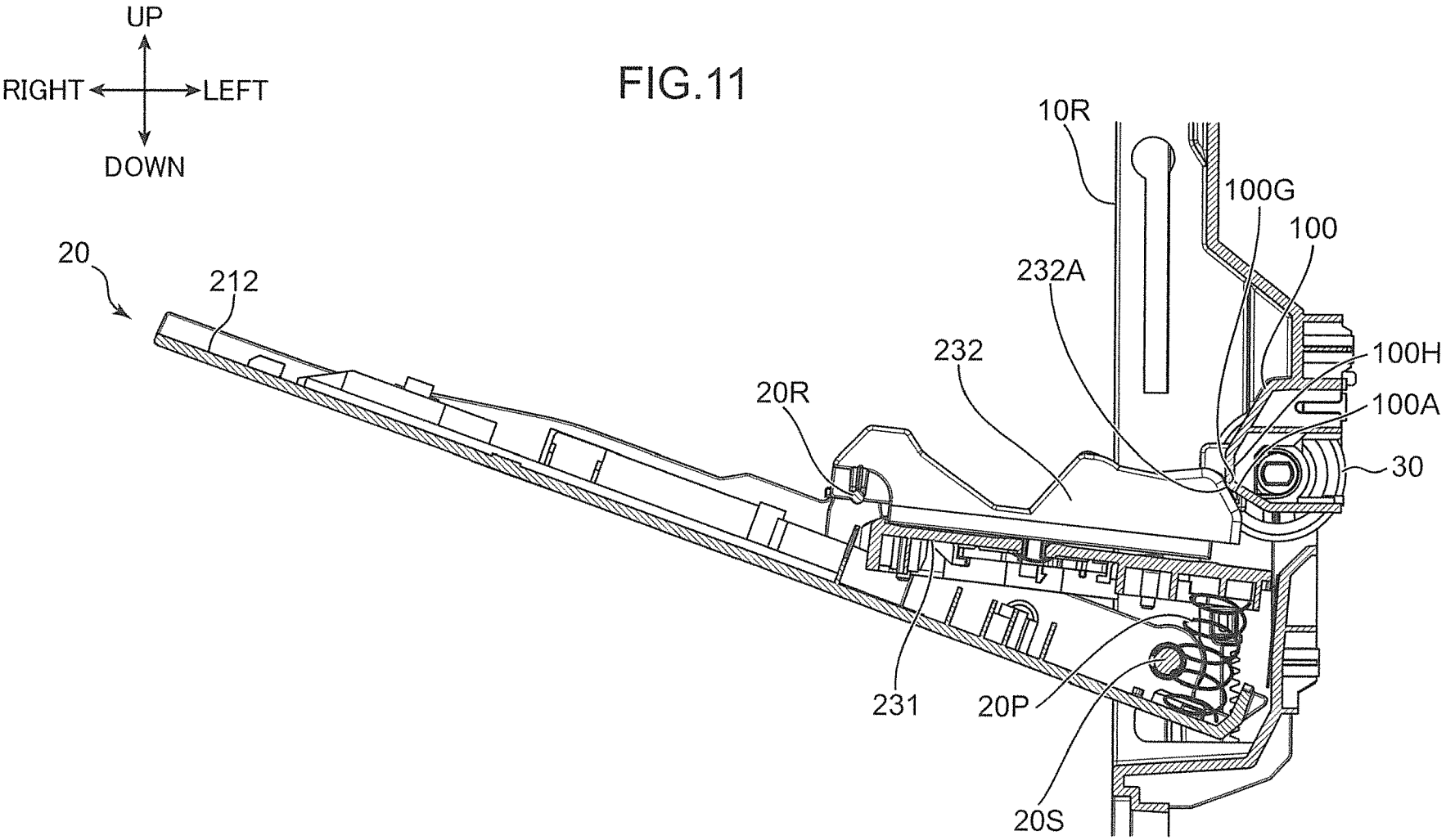
FIG. 11 is a section showing the state where the manual feed tray in the sheet feeding state is being closed with respect to the apparatus body of the image forming apparatus according to the second embodiment of the present disclosure.
Figure 12:
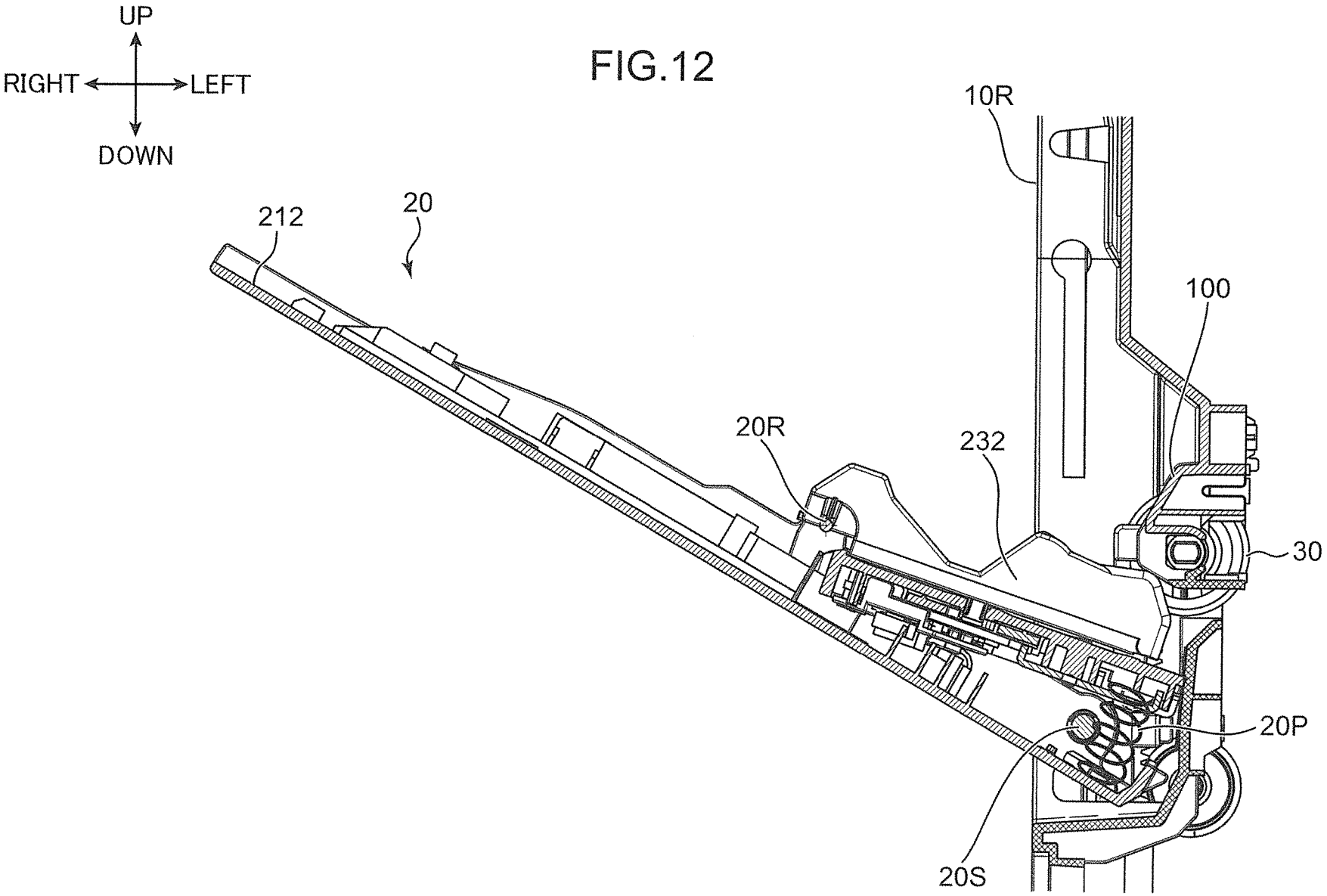
FIG. 12 is a section showing a state where the manual feed tray in the sheet feeding state is being closed with respect to the apparatus body of the image forming apparatus according to the second embodiment of the present disclosure.

In this embodiment, when the manual feed tray 20 starts being closed in a direction of an arrow from the state shown in FIG. 10, the guide portion 232A of the cursor 232 comes into contact with the ridgeline portion 100G of the facing wall portion 100 (FIG. 11). As a result, the guide portion 232A receives a drag force acting downward from the ridgeline portion 100G. As a result, the cursor 232 moves downward (in a direction toward the upper surface of a tray body 21) against a biasing force of a lift spring 20P (while compressing the lift spring 20P) (FIG. 12).

Figure 13:
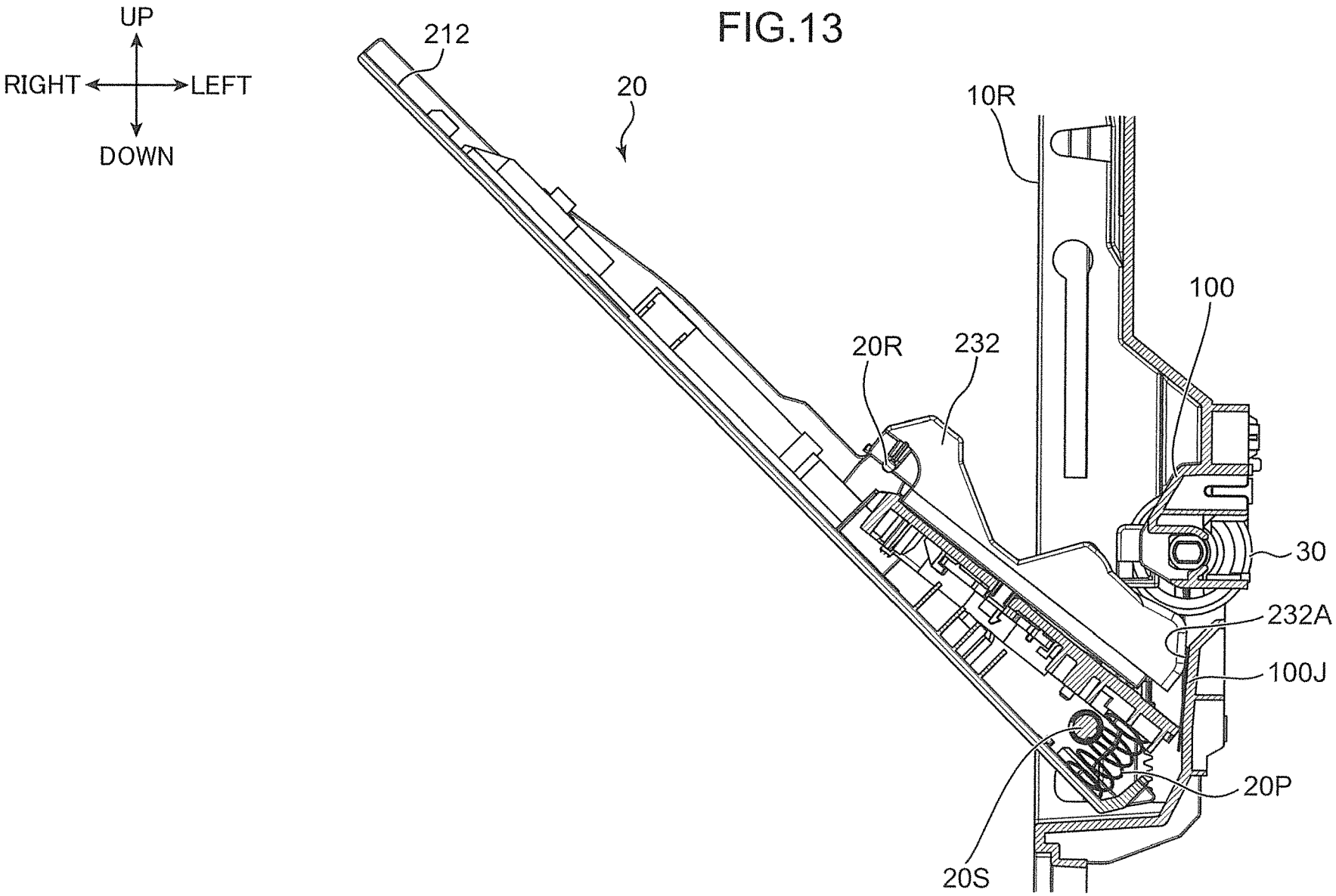
FIG. 13 is a section showing a state where the manual feed tray in the sheet feeding state is being closed with respect to the apparatus body of the image forming apparatus according to the second embodiment of the present disclosure.
Figure 14:
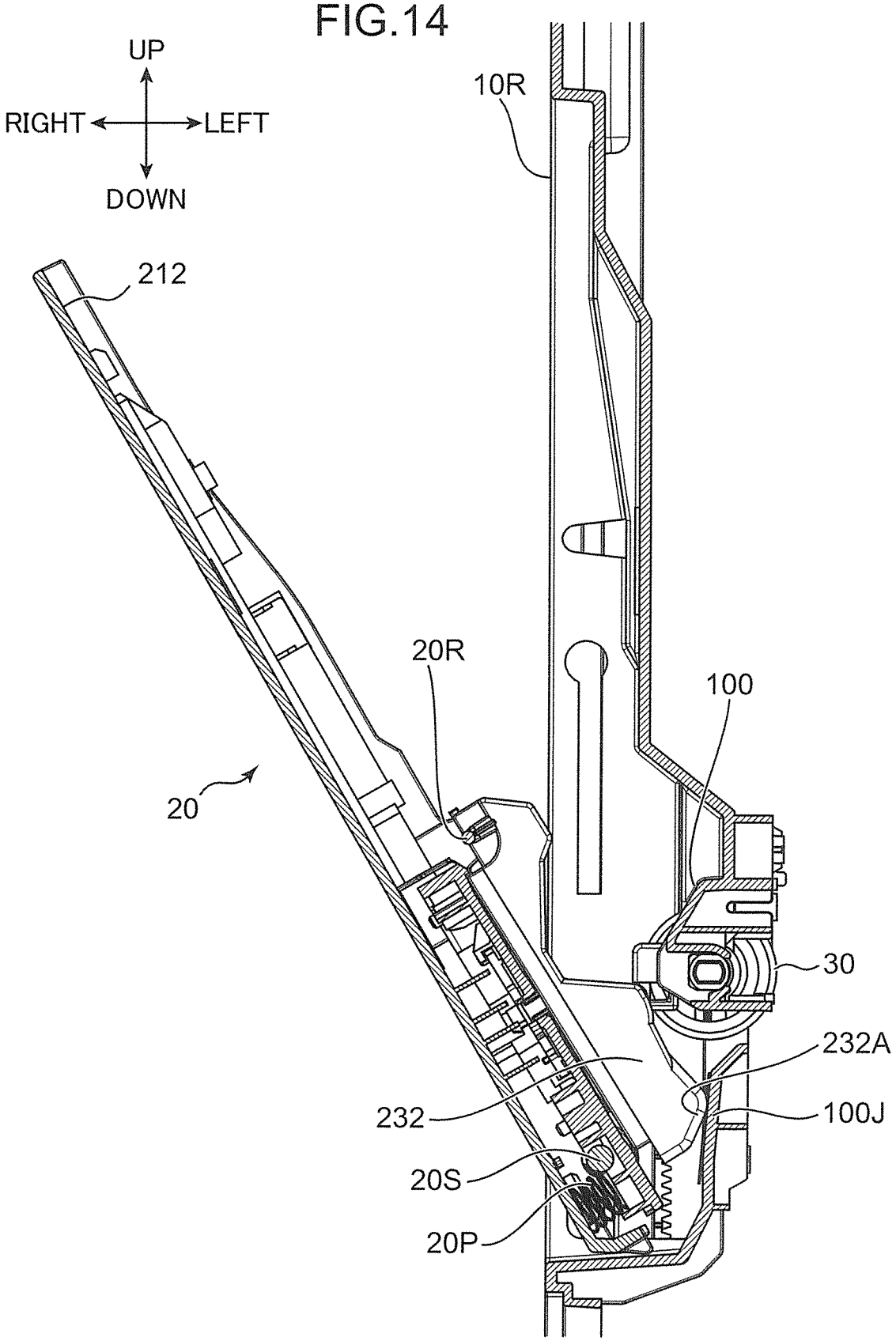
FIG. 14 is a section showing a state where the manual feed tray in the sheet feeding state is being closed with respect to the apparatus body of the image forming apparatus according to the second embodiment of the present disclosure.
Figure 15:
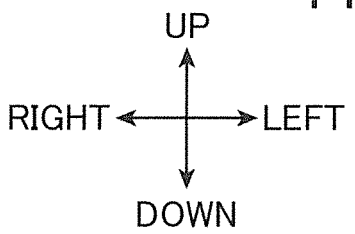
FIG. 15 is a section showing a state where the manual feed tray in the sheet feeding state is closed with respect to the apparatus body of the image forming apparatus according to the second embodiment of the present disclosure.
Figure 15:
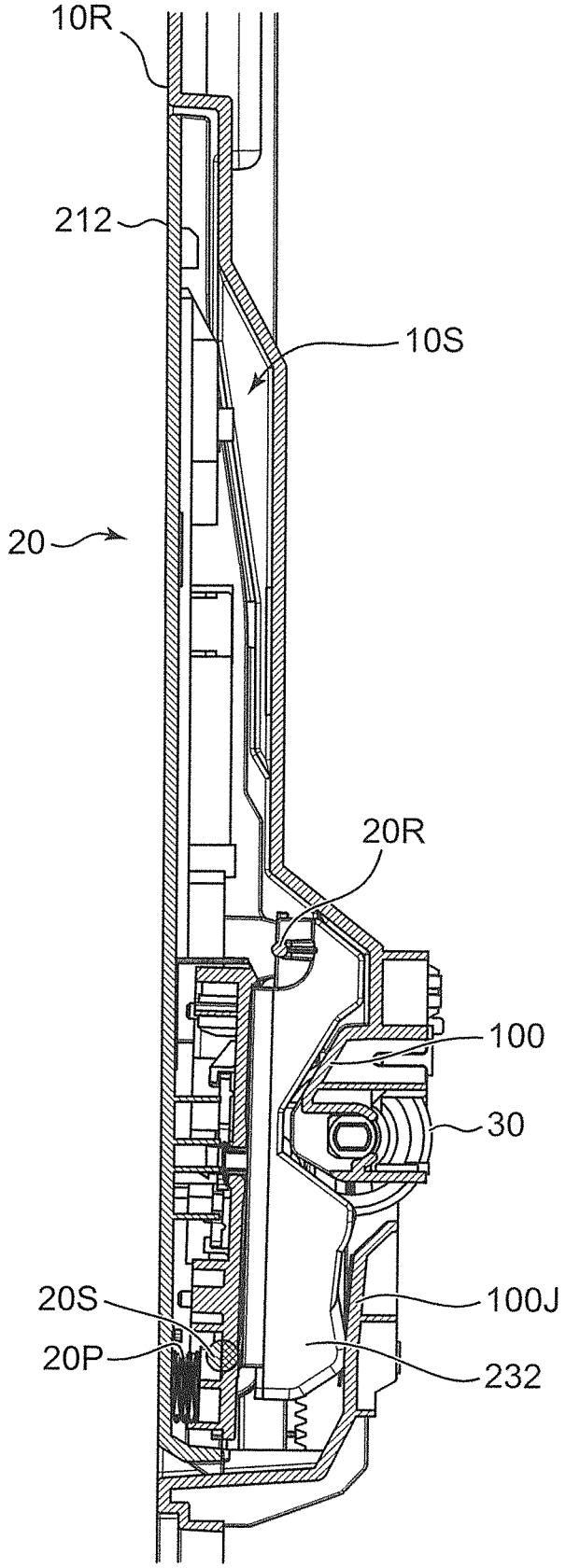

Eventually, the guide portion 232A comes into contact with a lower wall portion 100J formed to extend along the vertical direction below a sheet feed roller 30, thereby receiving a force for further compressing the lift spring 20P (FIGS. 13 and 14). Thereafter, the cursor 232 is arranged along the lower wall portion 100J in a tray housing portion 10S and the manual feed tray 20 is closed on a right wall 10R of the apparatus body 10 (FIG. 15).

As described above, also in this embodiment, downstream sides of the cursors 232 in the conveying direction smoothly move to positions below the facing wall portions 100 even if the manual feed tray 20 is closed in the sheet feeding state of the lift plate 231. Thus, strong interference of the cursors 232 and the facing wall portions 100 is suppressed. As a result, the damage and fracture of the cursors 232 and the facing wall portions 100 are suppressed. Further, in this embodiment, the guide portion 232A slides on the facing wall portion 100 when the manual feed tray 20 is closed, whereby the cursor 232 is guided into the tray housing portion 10S.

Note that, in the first and second embodiments, the pulley 50 and the guide portion 232A constituting the pressed portion of the present disclosure can be arranged at a plurality of positons in the sheet width direction to face the facing wall portion 100 according to a movement of the cursor 232 (see FIG. 4). Thus, even if a sheet of a different size is placed on the manual feed tray 20 and the position of the sheet in the width direction is restricted by the pair of cursors 232, strong interference of the cursors 232 and the facing wall portions 100 is suppressed when the manual feed tray 20 is closed.

Further, if each of the pair of front and rear cursors 232 includes the pressed portion, the downstream sides of the cursors 232 in the conveying direction can more smoothly move to the positions below the facing wall portions 10 when the manual feed tray 20 is closed. Thus, the damage and fracture of the cursors 232 and the facing wall portions 100 are further suppressed.

Note that if the pulley 50 is provided on the tip part of the cursor 232 as in the first embodiment, the downstream sides of the cursors 232 in the conveying direction can more smoothly move to the positions below the facing wall portions 10 by the rotation of the pulley 50 when the manual feed tray 20 is closed.

Further, by using a part (guide portion 232A) of the cursor 232 as the pressed portion as in the second embodiment, the damage and fracture of the manual feed tray 20 and the apparatus body 10 are suppressed by a simple configuration of the cursor 232. Further, by pressing the guide portion 232A utilizing the ridgeline portion 100G between the vertical wall 100H and the inclined wall 100A, a downward acting drag force can be reliably generated for the cursor 232.

Further, by arranging the pressed portion on the cursor 232 as in each of the above embodiments, the pressed portion can be arranged at a higher position as compared to the case where the pressed portion is arranged on the tip part of the lift plate 231. Thus, the pressed portion can be brought into contact with the facing wall portion 100 in an early stage when the manual feed tray 20 is closed. Further, to exhibit the function of the pressed portion while arranging the tip part (downstream end part in the conveying direction) of the lift plate 231 right below the sheet feed roller 30 as shown in FIG. 10, the pressed portion is desirably arranged on the tip part of the cursor 232.

The manual feed tray 20 and the image forming apparatus 1 including the manual feed tray 20 according to each embodiment of the present disclosure have been described above. According to such an image forming apparatus 1, the damage of the manual feed tray 20 and the apparatus body 10 when the manual feed tray 20 is closed can be suppressed. Note that the present disclosure is not limited to the respective embodiments described above. As described above, the pressed portion according to the present disclosure may be provided on each of the pair of cursors 232. Further, the pulley 50 according to the first embodiment may not rotate. Furthermore, a member having high slidability may be used in a part of the facing wall portion 100 with which the pulley 50 or the guide portion 232A comes into contact.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

an apparatus body;

an image forming unit arranged in the apparatus body and configured to form an image on a sheet;

a manual feed tray supported openably and closably with respect to a side surface of the apparatus body and including a sheet placing portion on which the sheet is to be placed in an open state with respect to the apparatus body;

a sheet feed roller provided in the side surface and configured to convey the sheet placed on the manual feed tray in a predetermined conveying direction, the sheet feed roller having opposite first and second ends; and first and second facing wall portions arranged respectively at the first and second ends of the sheet feed roller in a sheet width direction orthogonal to the conveying direction in the side surface and arranged to face the manual feed tray in a closed state of the manual feed tray with respect to the side surface;

wherein the manual feed tray includes:

a tray body constituting the sheet placing portion;

a lift plate arranged on a downstream side of the tray body in the conveying direction and supported swingably on the tray body to bring a downstream part of the sheet in the conveying direction into contact with the sheet feed roller;

a biasing member arranged between the lift plate and the tray body and configured to bias the lift plate so as to bring the sheet placed on the sheet placing portion into contact with the sheet feed roller; and first and second cursors supported on the lift plate so as to move in the sheet width direction and configured to restrict a position of the sheet in the sheet width direction;

the lift plate includes first and second pivot portions arranged on an upstream side in the conveying direction and supported on the tray body, the lift plate being swingable in directions toward and away from an upper surface of the tray body about the first and second pivot portions;

a first pressed portion formed on a downstream end part of the first cursor and arranged with a predetermined interval between the first facing wall portion and the first pressed portion in a sheet feeding state where a downstream part of the lift plate is moved upward with the manual feed tray in the open state; and the downstream part of the lift plate moves in the direction toward the upper surface of the tray body against a biasing force of the biasing member by the contact of the first pressed portion with the first facing wall portion when the manual feed tray is closed in the sheet feeding state.

2. An image forming apparatus according to claim 1, wherein:

the second cursors includes a second pressed portion formed on a downstream end part of the second cursor and arranged with a predetermined interval between the second facing wall portion and the second pressed portion in the sheet feeding state where the downstream part of the lift plate is moved upward with the manual feed tray in the open state; and the downstream part of the lift plate moves in the direction toward the upper surface of the tray body against the biasing force of the biasing member by the contact of the first and second pressed portions with the first and second facing wall portions when the manual feed tray is closed in the sheet feeding state.

3. An image forming apparatus according to claim 1, wherein:

the first pressed portion includes an inclined surface facing to the first facing wall portion.

4. An image forming apparatus according to claim 1, wherein:

the first pressed portion is a rotary member supported rotatably on a downstream side of the first cursors; and an outer peripheral surface of the rotary member is arranged closer to the first facing wall portion than a downstream end part of each of the first and second cursors in the sheet feeding state.

5. An image forming apparatus according to claim 1, wherein:

the sheet feed roller is arranged in a central part of the side surface in the sheet width direction; and the first pressed portion is arranged to face the first facing wall portion at a plurality of positions which the first cursor is positioned in the sheet width direction.

6. An image forming apparatus according to claim 1, wherein:

the first facing wall portion includes a first wall portion extending along a vertical direction and a second wall portion inclined so as to extend from a lower end part of the first wall portion toward a downstream side in the conveying direction, and a ridgeline portion projecting toward an upstream side in the sheet feed direction, which is formed in a part where the first wall portion and the second wall portion intersect; and the first pressed portion comes into contact with the ridgeline portion of the first facing wall portion when the manual feed tray is closed from the sheet feeding state.

7. An image forming apparatus according to claim 1, further comprising a tray housing portion formed to be recessed in the side surface, wherein:

the first and second cursors are guided into the tray housing portion by a sliding movement of the first and second pressed portion on the respective first and second facing wall portions when the manual feed tray is closed.

* * * * *